US005330408A

United States Patent [19]

Westmoreland, Jr.

[11] Patent Number: 5,330,408

[45] Date of Patent: Jul. 19, 1994

[54] APPARATUS FOR MAXIMIZING PUSH-UPS

[76] Inventor: Herbert L. Westmoreland, Jr., 2009 Jerome Blvd., Racine, Wis. 53403

[21] Appl. No.: 985,814

[22] Filed: Dec. 3, 1992

[51] Int. Cl.[5] ..... A63B 26/00

[52] U.S. Cl. ..... 482/141; 482/92; 482/133

[58] Field of Search ..... 482/133, 139, 142, 141, 482/95, 97, 114, 92, 93, 96, 115, 140, 144

[56] References Cited

U.S. PATENT DOCUMENTS

| | | | |
|---|---|---|---|
| 350,932 | 10/1886 | Keating | 482/56 |
| 1,329,660 | 2/1920 | Kaye | 482/56 |
| 1,620,146 | 3/1927 | Walton | 482/56 |
| 1,984,165 | 12/1934 | Tolchin | 482/95 |
| 3,589,720 | 6/1971 | Agamian | 482/114 |
| 3,640,527 | 2/1972 | Proctor | 482/100 |
| 3,731,921 | 5/1973 | Andrew, Jr. | 482/62 |
| 3,759,511 | 9/1973 | Zinkin et al. | 482/115 |
| 4,332,381 | 6/1982 | Lyons | 482/140 |
| 4,915,373 | 4/1990 | Walker | 482/114 |
| 5,106,079 | 4/1992 | Escobedo et al. | 482/141 |
| 5,178,593 | 1/1993 | Roberts | 482/62 |

*Primary Examiner*—Stephen R. Crow
*Assistant Examiner*—Jerome Donnelly

[57] ABSTRACT

The apparatus for maximizing push-ups comprises a base from which upwardly extend a foot rest, a torso support platform and a pair of laterally rotatable hand graspable arms. The foot rest is horizontally adjustable in relative distance to the torso support platform and the torso support platform is adjustable in vertical height. The hand graspable arms include a resistive assembly engaged thereto, with the assembly tending to maintain the arms separated while a user of the apparatus attempts to maintain the arms closely spaced against action of the resistive assembly, increasing the effect of exercise.

9 Claims, 1 Drawing Sheet

APPARATUS FOR MAXIMIZING PUSH-UPS

BACKGROUND OF THE INVENTION

1. Field of the Invention

The present invention relates to an apparatus for maximizing the body building achieved by doing push ups, bent arm fly and seated dip exercises. More particularly, the apparatus includes a foot rest, a chest pad and pivotable resistive arms with hand grips thereon, all these structures being elevated above floor level. A person utilizing the apparatus must maintain the hand grips at a particular location relative to the torso, against a resistive force while exercising.

2. Description of the Prior Art

Heretofore various apparatus have been proposed for use in exercising the torso and arms.

In the Dissinger U.S. Pat. No. 4,900,015 a floor level exercise device is proposed which comprises two opposed cylindrical handle assemblies which are elevated above a center base, the handles being rotatable about a horizontal axis. Here, a horizontal force as well as a vertical force must be applied while using the device.

In the Agamian U.S. Pat. No. 3,572,701 there is disclosed a floor level exercise apparatus having a handrail support, a longitudinal guide track extending in a plane beneath and fore and aft of the handrail support, and a carriage slidable along the rail and adapted to be engaged by the feet of an individual using the apparatus for push ups and dips.

Further, the Yount et al U.S. Pat. No. 3,759,512 discloses an exercise machine having a wheeled base and a seat mounted thereon. Forward of the seat are provided a pair of spring biased levers which are pivotally supported at a level accommodating the seat. Further provided is a pedal crank assembly for use by the seated individual.

As will be described in greater detail hereinafter, the apparatus of the present invention differs from those previously proposed by elevating the user's body above floor level to a position where deeper dips can be accomplished and wherein the push up type exercises may be accomplished in a supported prone position.

SUMMARY OF THE INVENTION

According to the invention there is provided an apparatus for maximizing push-ups, the apparatus comprising:

a rectangular base;

an elevated foot rest nearer one end of the base;

an elevated torso engaging platform nearer an opposite end of the base;

a pair of laterally rotatable hand graspable arms which are biased away from one another positioned at the end of the base where the torso engaging platform is located, the arms rotating equally at all times.

DESCRIPTION OF THE PREFERRED EMBODIMENT

Figure 1:
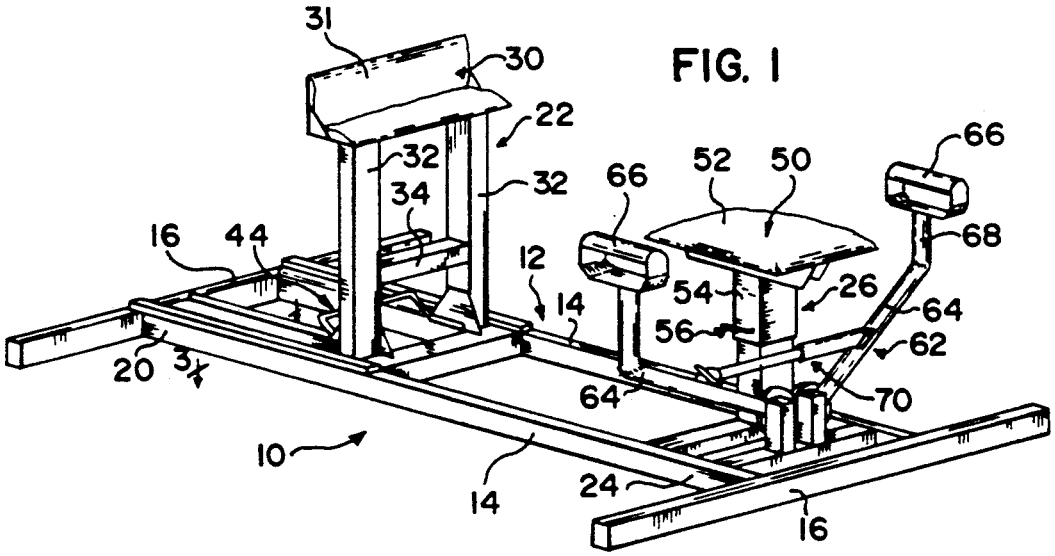
FIG. 1 is a perspective view of the apparatus of the present invention.

Referring now to the drawings in greater detail, there is illustrated therein the push-up apparatus of the present invention generally identified by the reference numeral 10.

As shown, the apparatus 10 includes a base 12 including two elongate members 14 which are spaced from one another as well as two shorter cross members 16, one engaged across cooperating pairs of ends of the elongate members 14, to create a stable, untippable base 12.

Extending upwardly from this base 12 toward one end 20 thereof is an elevated foot rest 22 which is horizontally adjustable toward or away from an opposite end 24 of the apparatus 10.

Figure 2:
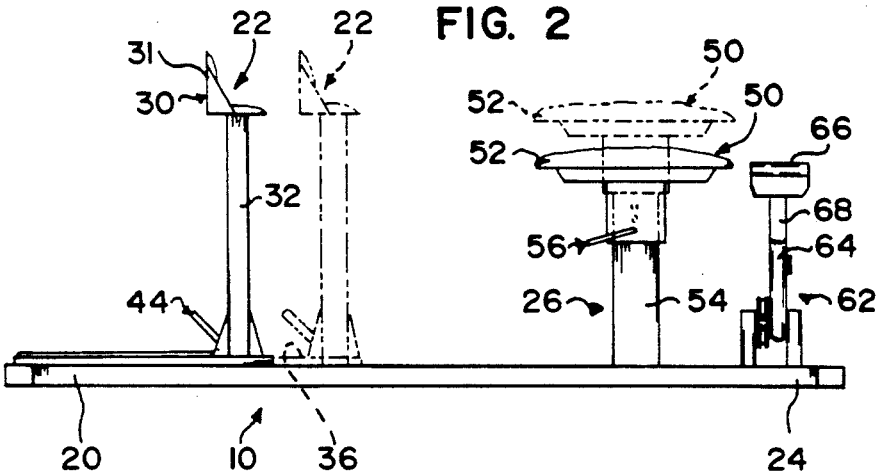
FIG. 2 is a side view of the apparatus showing in phantom that a foot rest and upper torso support thereof are movable.

The foot rest 22 is stabilized at a predetermined distance above the base 12 to allow a user of the apparatus 10 to dip deeply during exercise, to a distance greater than that which floor exercise would allow. However, to accommodate users of various leg length, the foot rest 22 has been designed to be movable toward and away from an upper torso support 26 located toward end 24 of the apparatus 10, as shown in phantom in FIG. 2.

The foot rest 22 is seen to comprise an L shaped foot engaging platform 30 having a sole engaging upright wall 31, to keep a user's feet from slipping off the platform 30.

The platform 30 is elevated above the base 12 by two vertical side bars 32 which engage a support member 34 therebetween.

Figure 3:
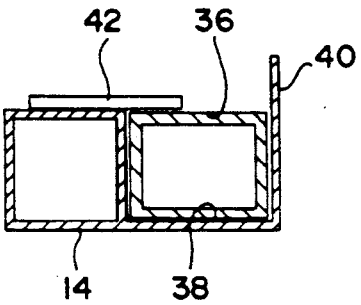
FIG. 3 is a cross sectional view through an area of engagement between a slide mechanism of the foot rest and a frame of the apparatus, taken along line 3—3 of FIG. 1.

To assure a solid engagement between the foot rest 22 and the base 12, while allowing same to be slidably engaged, it is proposed to form slides 36 which extend horizontally from the bottom of the side bars 32, as best illustrated in FIG. 3.

Each slide 36 is slidably received and engaged within a channel 38 formed alongside the corresponding base member 14.

As shown, the channel 38 is formed to maintain lateral position of the slide 36 by provision of vertical wall 40 and maintains the slide 36 against upward shift by provision of an abutting horizontal top flange 42.

Also, it will be seen from the Figure that the apparatus 10 is formed of squared metal tubes for added stability and strength.

In order to secure the foot rest 22 in a chosen position, any known suitable locking mechanism 44 may be provided.

Turning now to the end 24 of the apparatus 10, there is provided thereat an upper torso support platform 50. This platform 50 is fixed in position on the base 12 and includes a torso engaging pad 52 which is mounted a predetermined minimum distance above the base 12.

The torso pad 52 is supported on a telescoping pedestal 54, with the pedestal 54 being lockable in chosen vertical position in any suitable manner, such as by use of a locking mechanism 56.

Such telescoping capability allows for alternate use of the apparatus 10 in doing push ups or in doing seated dip exercises.

Also, if an extensive push up training session is desired, the user's chest may dip significantly below the level of the user's hands when the torso pad 52 is engaged at its lowermost position, increasing the effective level of the exercise.

Also positioned at end 24 of the apparatus 10 is an arm exercising system 62 including two pivotable arms 64 having a handgrip 66 seated on upper end 68 of each arm 64.

Between the pivotable arms 64 is engaged a resistive assembly 70 which maintains the arms 64 at a maximally spaced apart position thereof. Inasmuch as the arms 64 should be at all times maintained level during exercise, assembly 70 also must accomplish this goal.

Figure 4:
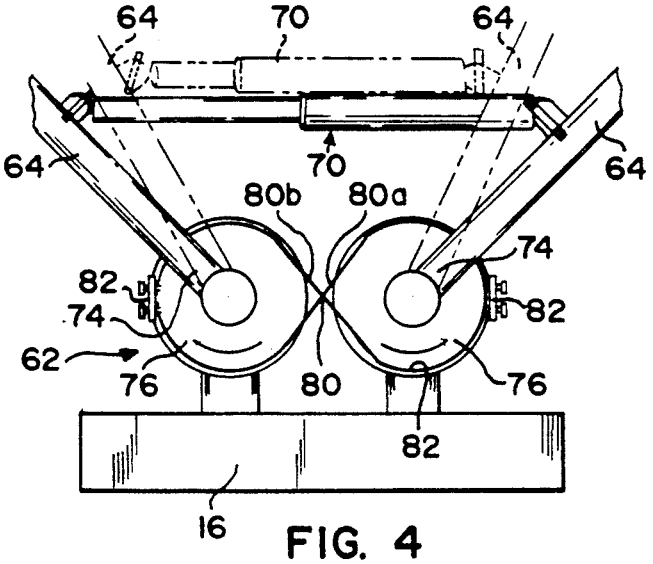
FIG. 4 is a perspective view of an area of engagement created between arms of the apparatus showing biasing structure engaged therebetween as well as a mechanism for maintaining the arms level at all times.

In the embodiment best shown in FIG. 4, such maintained levelness is produced by engaging pivotably mounted lower ends 74 of each arm to one of a pair of coacting pivot members 76.

These pivot members 76 coact in a manner where both gears rotate equally, by action of the resistive assembly 70 thereon. The resistive assembly 70 acts to maintain the arms 64 at their most separated position, as well as maintaining inward rotation of the arms 64 equal.

In this respect, the assembly 70 includes one or two bands 80 which thread around the pivot members 76 in a FIG. 8 pattern. The circumferential edge of the pivot members 76 is grooved, with the bands 80 seating within the groove 82 where contiguous with the pivot members 76.

The band or bands 80 are made of a frictional material such as rubber. To allow for tight engagement of the band 80 about the pivot members 76, lateral mounting brackets 82 are provided to allow for tightly stretched engagement of the band or bands 80 about the pivot members 76.

Provision of the band 80 in a tensed figure eight configuration provides for a transfer of force between the pivot members 76 to maintain them equal in relative position. In this respect, it will be understood that when one S shaped flight 80*a* of the band 80 is tensed in one direction, a reverse, equal and opposite tensioning of the other S shaped flight 80*b*, is caused. Thus, the forces are equalized on the pivot members 76, maintaining their rotation equal.

It will be seen that when the arms 64 are maximally spaced from one another, the handgrips 66 are at a vertical level approximately equal to that at which the torso engaging pad 52 rests when at its lowermost position. Also, there is a significant lateral spread between the handgrip 66, to an extent wider than a human torso in the shoulder area thereof.

For use in doing pushups particularly, the handgrip 66 must be brought toward one another so that the user's arms remain vertical below the shoulders. Bringing of the handgrip 66 toward one another causes an increased resistance to be produced by the resistive assembly 70 in a laterally outward direction. Thus, the user is forced to concentrate on maintaining the arms vertical against the force being exerted by the resistive assembly 70.

The user's battle against the resistive force causes an increased level of muscle exercise which inherently produces better body building and muscle definition.

It will be understood that the user must continuously pull the handgrip 66 toward one another and such repetitive muscle tensing is an action that cannot be gained through floor exercise.

Further, when the handgrip 66 are at their uppermost, closest position, they are significantly elevated above the torso engaging pad 52 allowing the user to dip therebetween while the user's arms spread under effect of the resistive assembly 70. Thus, the downward extent of exercise is significantly increased over that which can be accomplished with floor exercise, again increasing the effect of the exercise being performed.

As described above, the apparatus 10 provides a number of advantages, some of which have been described above and others of which are inherent in the invention. Also, modifications may be proposed to the apparatus 10 without departing from the teachings herein.

Accordingly the scope of the invention is only to be limited as necessitated by the accompanying claims.

I claim:

1. An apparatus for maximizing push-ups, the apparatus comprising:

a rectangular base;

an elevated foot rest nearer one end of the base;

an elevated torso engaging platform nearer an opposite end of the base, said foot rest being horizontally movable toward and away from said elevated torso engaging platform; and a pair of hand graspable arm members each having a first end and a second end respectively;

at least one pivotal mounting means which is located at a position below said elevated torso engaging platform wherein a first end of each of said arm members is connected, to allow pivotal movement of said arm members;

said second end of said arm members being positioned substantially vertically above said first end of said arm members on opposite sides of said torso engaging platform, respectively; and a biasing means which maintains said arm members at an equally spaced distance away from one another at all times while the arm members are pivoted by a user, toward and away from each other when performing routines which include push-ups, bent arm and seated dip exercises.

2. The apparatus of claim 1 wherein said torso engaging platform includes a pad which is vertically movable.

3. The apparatus of claim 2 wherein said arms are each joined to a pivotable member.

4. The apparatus of claim 3 wherein said arms engage a resistive assembly which acts to maintain the arms apart.

5. The apparatus of claim 4 wherein said pivotable members have a circumferential edge with a groove provided therein.

6. The apparatus of claim 5 wherein at least one band of frictional material is wound around the circumferential edge of both pivotable members within said groove therein, the band having a figure eight pattern when engaged about said pivotable members.

7. The apparatus of claim 6 wherein said band is fixed in position about said pivotable members and tensed thereagainst by means of mounting brackets engaged at opposite ends of the figure eight.

8. The apparatus of claim 7 wherein said foot rest is provided with slides on a bottom thereof, said slides engaging in a track in said base, with said slides being lockable in a chosen position along said track.

9. The apparatus of claim 8 wherein said torso engaging platform includes a pad thereon, said pad being telescopically engaged to said base and being lockable at a chosen position above said base.

* * * * *